United States Patent [19]

Fort

[11] 4,257,474

[45] Mar. 24, 1981

[54] ADJUSTABLE SUPPORT FOR THE METAL SUPPLY UNIT FOR A MACHINE FOR CENTRIFUGALLY CASTING PIPES

[75] Inventor: Pierre H. M. Fort, Nancy, France

[73] Assignee: Pont-A-Mousson S.A., Nancy, France

[21] Appl. No.: 2,138

[22] Filed: Jan. 9, 1979

[30] Foreign Application Priority Data

Jan. 27, 1978 [FR] France ..... 78 02278

[51] Int. Cl.[3] ..... B22D 13/10

[52] U.S. Cl. ..... 164/299; 164/298

[58] Field of Search ..... 164/298, 299, 300, 301, 164/286; 193/38, 15, 17; 198/862; 248/661, 422, 417; 254/89 H, 89 R, 92, 13, 45

[56] References Cited

U.S. PATENT DOCUMENTS

| | | | |
|---|---|---|---|
| 1,864,270 | 6/1932 | Eurich et al. | 164/298 |
| 2,074,537 | 3/1937 | Camerota | 164/301 |
| 3,456,716 | 7/1969 | Lorang | 164/301 |

FOREIGN PATENT DOCUMENTS

| | | | |
|---|---|---|---|
| 451653 | 10/1948 | Canada | 254/89 H |
| 454159 | 12/1927 | Fed. Rep. of Germany | 193/15 |
| 677289 | 5/1939 | Fed. Rep. of Germany | 164/301 |
| 430464 | 2/1948 | Italy | 164/299 |

*Primary Examiner*—Robert D. Baldwin
*Assistant Examiner*—K. Y. Lin
*Attorney, Agent, or Firm*—Sughrue, Rothwell, Mion, Zinn and Macpeak

[57] ABSTRACT

This support is adapted to support pouring spouts at the upstream end of two pouring channels which are mounted on a common carriage which is movable transversely. It comprises a platform mounted on the movable carriage by a device which is adjustable in height. This device is disposed between the two pouring channels and provided with actuating means including motion direction changing means such as bevel gears. This platform is slidable on two guide pillars carried by the carriage on each side of the device adjustable in height and between the two pouring spouts.

2 Claims, 6 Drawing Figures

FIG. 1
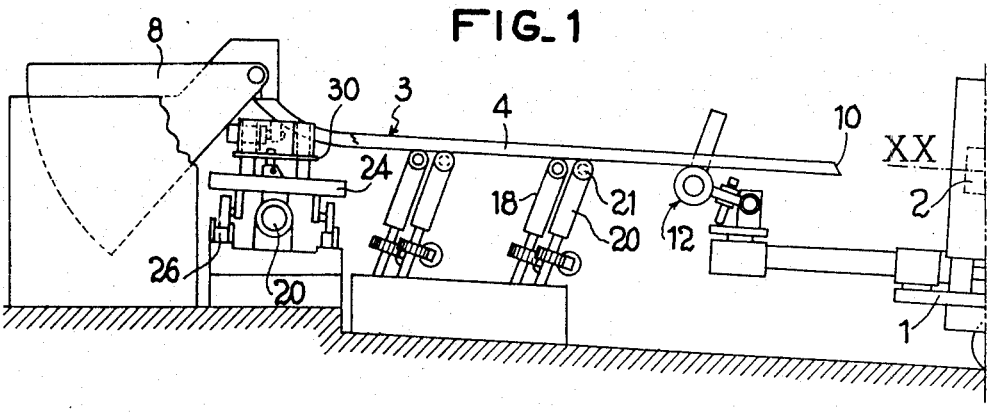
FIG. 2
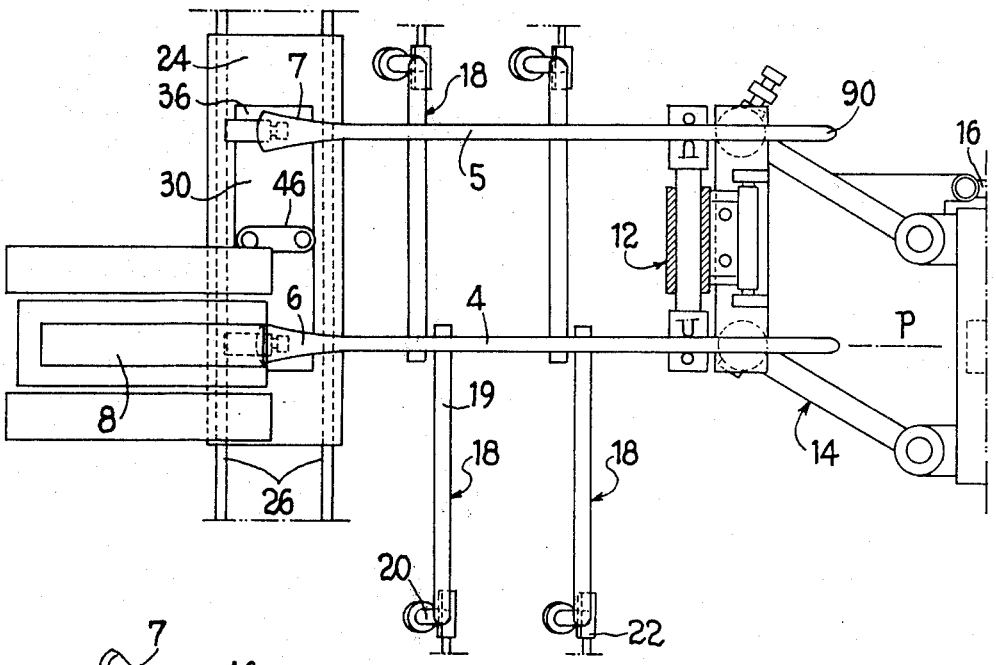
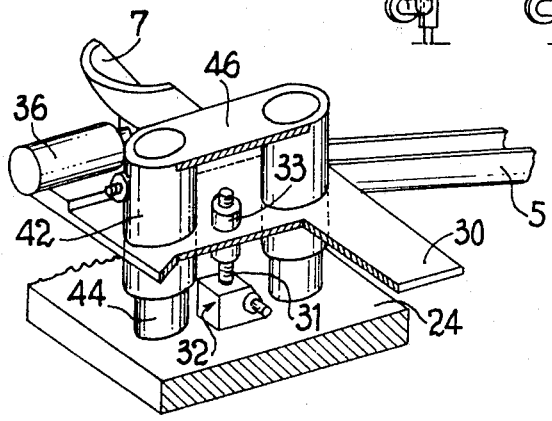
FIG. 6

ADJUSTABLE SUPPORT FOR THE METAL SUPPLY UNIT FOR A MACHINE FOR CENTRIFUGALLY CASTING PIPES

DESCRIPTION

The present invention relates to a machine for centrifugal casting, more particularly intended for making cast iron pipes, of the type comprising a rotary mould and a metal supply unit for this mould which comprises pouring channels, the upstream ends of which are mounted on a carriage which is movable in a direction perpendicular to the direction of the channels so as to bring each of the channels alternately below a pouring ladle, the supply unit and the mould being longitudinally movable with respect to each other in each position of the carriage.

Machines of this type may be employed with casting moulds of different diameters so that it is necessary to be able to adjust in height the position of the two pouring channels to adapt them to the various moulds. The adjustment of the various supports arranged along each pouring channel presents no difficulty. It is usually achieved by means of height adjusting screws which are easily accessible.

This is not the case for the upstream end or pouring spout of each channel. Indeed, it is in the pouring position that the adjustment must be effected while the pouring spout is located under the tiltable pouring ladle. The access to adjusting screws applied to the turning over trunnion of the channel is not very convenient, since the space between the ladle and the pouring spout is extremely small. In order to increase this space, the ladle must be raised when it is empty and maintained in a raised position during the entire adjusting operation, which renders the latter long and fastidious.

An object of the present invention is to overcome this drawback and to provide a support for the metal supply unit which enables the height of the two pouring spouts to be adjusted simultaneously and is always accessible.

According to the invention, there is provided a support which is adjustable in height for a metal supply unit of a casting machine, this support comprising a support platform for the two pouring spouts which are mounted on the carriage for moving the channels in translation through a device adjustable in height disposed between the two channels and provided with actuating means including motion direction changing means.

In one embodiment of the invention, the platform slides in the upward and downward directions on guide pillars carried by the carriage on each side of the device which is adjustable in height, the axes of pillars being located in a vertical plane perpendicular to the platform between the two pouring channels.

According to a feature of the invention, the device adjustable in height is a screw jack connected by motion direction changing means comprising two actuating shafts extending in opposite directions.

With this arrangement, the device adjustable in height, or screw jack, which is located between the two shoots is never completely below the tiltable pouring ladle and consequently remains always accessible laterally of the pouring spouts. Further, the pouring spouts of the two pouring channels may be displaced simultaneously in height by a simple action on the screw jack.

The ensuing description of one embodiment, given merely by way of example and shown in the accompanying drawings, will show the advantages and features of the invention. In the drawings:

FIG. 1 is a diagrammatic elevational view of the iron supply unit of a centrifugal casting machine provided with a support which is adjustable in height according to the invention;

FIG. 2 is a plan view of the unit shown in FIG. 1;

FIG. 6 is a diagrammatic perspective view with parts cut away of the support according to the invention.

Figure 3:
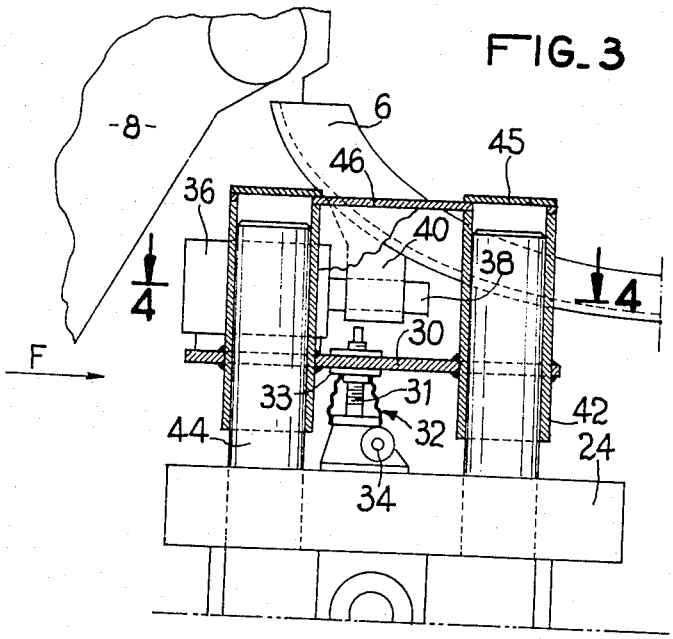
FIG. 3 is an elevational view partly in section, to an enlarged scale, of the adjustable support according to the invention.

As shown in FIGS. 1 and 2, the invention is more particularly applicable to machines for centrifugally casting small-diameter cast iron pipes of the type described in French patent application No. 77 33 223, filed on Nov. 4, 1977 by the applicant. This machine, which is of the de Lavaud type, comprises a carriage 1 carrying a centrifugally casting mould or shell 2 which is rotatable about an axis X—X, and a supply unit generally designated by the reference 3 which comprises two pouring channels 4 and 5 of great length and small section and capable of entering the mould 2 to the end of the latter in the course of the travel of the carriage 1 along these channels. The upstream end of each of the channels 4 and 5 is formed by a pouring spout respectively 6 and 7 and one of these pouring spouts is placed below a tiltable pouring ladle 8 in the shape of a sector of a circle containing the molten iron.

Adjacent its downstream end which forms an outlet 10, each of the channels 4 and 5 bears on an L-section support 12 which constitutes a horizontal side parallel to the carriage 1 of a parallelogram structure 14 carried by the carriage of the machine and for example actuated by a jack 16 only the actuating rod of which is shown in FIG. 2.

At points intermediate their ends, the channels 4 and 5 are carried by supports 18 cranked at 90° and having consequently a channel support branch 19 and a branch 20 for pivotally mounting the support at a fixed point of the machine. These supports are laterally withdrawable owing to the provision of an inclined gear pinion 21 which is engaged with a jack-rack system 22. These supports are for example those described in detail in the French Pat. No. 1,002,389. These supports are adjustable in height, the vertical branch 20 being preferably formed by a screw which co-operates with a fixed nut and is capable of being actuated from the upper part of the support 18.

The upstream ends of the pouring channels 4 and 5, which are divergent so as to constitute the pouring spouts 6 and 7, are mounted on a carriage 24 which is movable in translation on rails 26 perpendicular to the pouring channels 4 and 5 and consequently to the plane P containing the axis of the rotary mould 2 and the plane of the channel which supplies metal to this mould, that is to say the channel 4 in the case shown in FIG. 2. According to the invention, the pouring spouts 6 and 7 are supported by a platform 30 which is mounted on the carriage 24 by means of a device 32 which is adjustable in height and which, in the embodiment illustrated in the drawings, is formed by a screw jack whose screw 31 extends in a direction perpendicular to the platform 30 and is engaged in a nut 33 which is secured to this platform 30. The screw 31 is solely movable in rotation and is connected by motion direction changing means, such as bevel gears (not shown), to two coaxial actuating shafts 34, 35 which extend in opposite directions.

Figure 5:
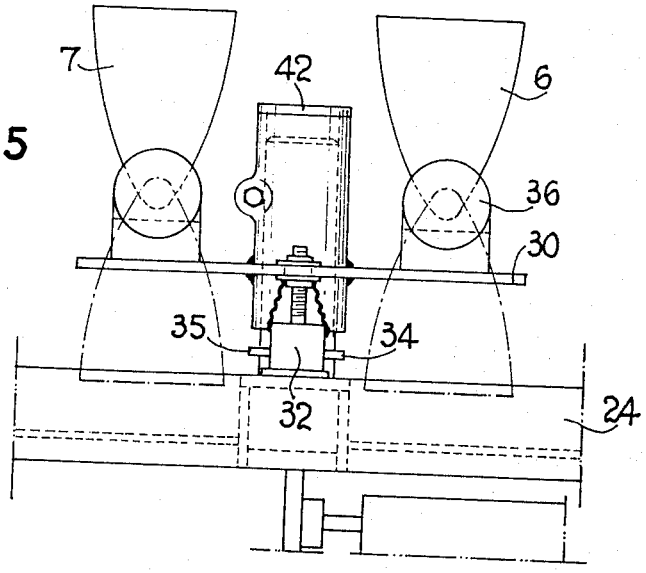
FIG. 5 is a side elevational view of the device shown in FIG. 3 in the direction of arrow F in the latter.

The support and adjusting device 32 is disposed in such manner as to act on the centre part of the platform 30. On each side of this device 32, the platform 30 supports (FIGS. 3 and 6), in the vicinity of each of its ends, a hydraulic or fluid motor 36 which is capable of driving in rotation through 180° a trunnion 38 which is connected to rotate with an ear 40 by keying, this ear being rigid with the lower part of the corresponding pouring spout 6 or 7. The trunnion 38 is parallel to the platform 30 and perpendicular to the rails 26 guiding the movement of the carriage 24 so that its rotation through 180° results in the pivoting of the corresponding pouring spout 6 or 7 between a normal position for supplying the pouring channel which is shown in full lines in FIG. 5, and an inverted position for emptying this channel shown in dot-dash lines in FIG. 5.

Figure 4:
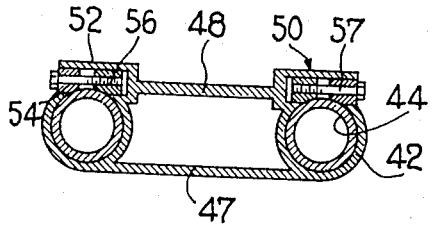
FIG. 4 is a sectional view taken on line 4—4 of FIG. 3 of the platform guiding pillars.

The platform 30 further comprises on each side of the device 32 two hollow cylinders 42 which extend therethrough and beyond both sides and slide, each one, on a guide pillar 44 rigid with the carriage 24. Preferably, the cylinders 42 are closed at 45 in their upper part and interconnected by an upper wall 46 and two lateral walls respectively 47 and 48 (FIG. 4). The cylinders 42 are freely slidable on the pillars 44 but are provided with a device 50 for locking them in any desired position. For this purpose, each of the cylinders 42 has a longitudinal slot one of the edges of which is extended to form a case 52 which is closed by a clamping shoe 54 which is fixed and rigid with the second edge of the slot of the cylinder 42. A second clamping shoe 56 is slidably mounted inside the case 52 and is controlled by a screw 57 which extends through the first shoe 54 and may be operated from outside the case 52. It will be understood that a simple unscrewing of the screw 57 urges the shoe 56 into the case 52 and releases the cylinder 42 relative to the pillar 44. On the other hand, the tightening of the screw 57 applies the shoe 56 against the pillar 44 and holds the corresponding cylinder 47 in position.

Preferably, and as shown in the drawings, especially in FIG. 2, the guide columns 44 are disposed on the platform 30 between the pouring spouts 6 and 7 on each side of the adjusting and supporting device 32 so that the plane containing their axes is perpendicular to the rails 26 and coincides with the plane of symmetry of the channels 4 and 5. The shafts or pins 34 and 35 then extend in a direction perpendicular to this plane, that is to say in a direction parallel to the rails 26. Consequently, irrespective of the position of the channels 4 and 5 and carriage 24 relative to the ladle 8, one of the shafts, 34 or 35, is always accessible. Likewise, the screws 57 of the locking devices 50 may be easily reached from the exterior irrespective of the position of the carriage 24. When these screws 57 are untightened, the actuation of that one of the shafts 34 or 35 which is accessible enables the platform 30 to be shifted upwardly or downwardly the desired distance. This movement of the platform 30 results in a simultaneous identical displacement of the two pouring spouts 6 and 7 whose position relative to the pouring ladle 9 can thus be easily adjusted. When the desired position is reached, the screws 57 are tightened in order to firmly secure the cylinder 42 in position on the corresponding pillar 44. This locking of the cylinders 42 ensures that the pouring spouts are held in position not only in the vertical direction but also against the vibrations which are transmitted to the pouring channel by the rotating mould 2. Indeed, the two shoots are rigid both with each other and also with the platform 30, the pillars 44 and the carriage 24 so that the weight of the unit damps the vibrations.

The pouring spouts 6 and 7 are thus supported, not only in an adjustable manner, but also in an extremely rigid manner.

Having now described my invention what I claim as new and desire to secure by Letters Patent is:

1. In a support structure in combination with a unit which supplies iron to a machine for centrifugally casting tubular bodies and comprises a pouring ladle, two laterally spaced apart pouring channels having pouring spouts at their upstream ends and a common carriage which is movable in translation in a direction perpendicular to said channels and carries the pouring spouts, said carriage moving in said direction between two positions permitting the pouring spouts to be brought alternately in position under the ladle for conveying metal from the ladle into a mould of the casting machine while the other pouring spout is laterally offset from the ladle; the improvement wherein the support structure comprises a platform rigidly supporting the two pouring spouts, a single device which is adjustable in height and connects the platform to the carriage for adjusting the height of the platform relative to the carriage, and means for maintaining the platform horizontal and damping vibrations and comprising guide pillar means fixed on the carriage and rigid cylinder means rigidly fixed to the platform and slidably mounted on the pillar means, and releasable means interposed between the pillar means and cylinder means for rendering the cylinder means rigid with the pillar means, said pillar means and said single adjustable device being contained in a vertical plane mid-way between the two pouring spouts whereby easy access is had to the adjustable device and the releasable means when each channel is positioned under the ladle.

2. A support structure as claimed in claim 1, wherein said pillar means comprise two guide pillars contained in said vertical plane and said cylinder means comprise two cylinders slidably mounted on said pillars and said releasable means are provided between each pillar and cylinder.

* * * * *